US005107088A

United States Patent [19]

Aoki

[11] Patent Number: 5,107,088

[45] Date of Patent: Apr. 21, 1992

[54] COOKING APPLIANCES

[75] Inventor: Masayuki Aoki, Ichinomiya, Japan

[73] Assignee: Kabushiki Kaisha Toshiba, Kanagawa, Japan

[21] Appl. No.: 475,897

[22] Filed: Jan. 30, 1990

[30] Foreign Application Priority Data

Feb. 23, 1989 [JP] Japan ..... 1-43487

[51] Int. Cl.[5] ..... H05B 6/68; H05B 1/02

[52] U.S. Cl. ..... 219/10.55 B; 219/10.55 F; 219/10.55 C; 219/492; 219/493

[58] Field of Search ..... 219/10.55 B, 10.55 C, 219/492, 493, 494, 506

[56] References Cited

U.S. PATENT DOCUMENTS 4,517,431 5/1985 Ueda ..... 219/10.55 B
4,719,326 1/1988 Yoo ..... 219/10.55 B
4,755,646 7/1988 Fowler ..... 219/10.55 B

*Primary Examiner*—Bruce A. Reynolds
*Assistant Examiner*—Tuan Vinh To
*Attorney, Agent, or Firm*—Philip M. Shaw, Jr.

[57] ABSTRACT

A microcomputer-based control device for microwave ovens includes a timer defining an operation period of a magnetron and incorporated in the microcomputer, an encoder generating electrical pulses, the number of which is in accordance with an amount of angular displacement of an operation knob, the encoder being independent of the microcomputer, first and second semiconductor switches for starting an operation of the magnetron in response to either any one or a plurality of a pulse train generated by the encoder, the semiconductor switches being incorporated in the microcomputer, and a counter for setting, at the timer, a cooking period in accordance with the numer of pulses of the pulse train generated by the encoder.

6 Claims, 5 Drawing Sheets

| NO. | Operation of operation knob 11 | Display 4 | Normally open contact 30a |
|---|---|---|---|
| 1 | Standby | 0 | Off |
| 2 | Clockwise turn by one pitch | 0 | Off |
| 3 | Clockwise turn by one pitch after period T1 (T1>TO) | 0 | Off |
| 4 | Clockwise turn by one pitch within period TO | 10 | On |
| 5 | Left | (Countdown) 7 | On |
| 6 | Clockwise turn | (Addition) 5:34 | On |
| 7 | Left | (Countdown) 4:00 | On |
| 8 | Counterclockwise turn | (Subtraction) 2:28 | On |
| 9 | Left | (Countdown) 1:30 | On |
| 10 | Counterclockwise turn | (Subtraction) 0 | Off |

FIG. 8

COOKING APPLIANCES

BACKGROUND OF THE INVENTION

This invention relates to cooking appliances wherein start and interruption of a cooking operation such as heating food and a cooking period are controlled by a microcomputer-based control device.

The cooking operation is executed under control of the microcomputer-based control device in increasing number of cooking appliances such as microwave ovens.

In conventional microwave ovens of the type described above, an operation knob for setting the cooking period is turned to set a desirable cooking period. Thereafter, when a cooking start key is depressed, the control device operates to energize a magnetron for the cooking period set, thereby executing the heating cooking On the other hand, when the cooking period is reset during execution of the heating cooking, a cancel key is depressed and then, the operation knob is turned in the same manner as described above so that a new cooking period is set. Subsequently, upon depression of the start key, the control device operates to restart the heating cooking.

The above-described conventional arrangement has the following two disadvantages: first, start of the heating cooking necessitates the turning of the operation knob and depression of the start key, which operations to start the heating cooking are troublesome. Second, the reset of the cooking period during execution of the heating cooking necessitates operations of the cancel key, operation knob and cooking start key, which operations to change the cooking period is also troublesome.

SUMMARY OF THE INVENTION

Therefore, an object of the invention is to provide a cooking appliance wherein the cooking period setting and the cooking start may be performed by one operation of a single operation knob, thereby simplifying the cooking starting operation.

Another object of the invention is to provide a cooking appliance wherein the cooking period may be changed during execution of the cooking operation by one operation of a single operation knob, thereby simplifying the cooking period changing operation.

The present invention provides a cooking appliance including cooking means for cooking food, a control device for controlling the cooking means, the control device including a microcomputer, and a manual operation member provided so as to be displaced when manually operated. The control device comprises timer means for defining an operation period of the cooking means, said timer means being incorporated in the microcomputer, pulse signal generating means for generating a pulse train having pulses the number of which is in accordance with an amount of displacement of the operation member, said pulse signal generating means being provided independent of the microcomputer, start means for starting an operation of the cooking means in response to either any one or a plurality of pulses of the pulse train generated by the pulse signal generating means, said start means being incorporated in the microcomputer, and period setting means for setting, at the timer means, a period in accordance with the number of pulses of the pulse train generated by the pulse signal generating means.

Pulse signals are generated by the pulse signal generating means in accordance with displacement of the operation member and the number of the pulse signals is utilized as a cooking period information. The control device operates to start the cooking operation and control the subsequent cooking operation. Consequently, both of start of the cooking operation and the cooking period setting are performed by one operation of a single operation member.

The invention may also be practiced by a cooking appliance including cooking means for cooking food, a control device for controlling the cooking means, the control device including a microcomputer, and a manual operation member provided so as to be displaced when manually operated. The control device comprises timer means for defining an operation period of the cooking means, said timer means being incorporated in the microcomputer, pulse signal generating means for generating first and second electrical pulse trains in response to a displacement of the operation member, the number of pulses of each pulse train being in accordance with an amount of displacement of the operation member, said first and second pulse trains having a phase difference therebetween, the phase-lead-lag of said pulse trains being determined by the directions of displacement of the operation member, said pulse signal generating means being provided independent of the microcomputer, start means for starting an operation of the cooking means in response to either any one or a plurality of pulses of at least any one of the first and second pulse trains generated by the pulse signal generating means, said start means being incorporated in the microcomputer, period setting means for setting, at the timer means, a period in accordance with the number of pulses of any one of the pulse trains generated by the pulse signal generating means, and means for adding or subtracting, to or from the time length value currently set in the timer means, a period in accordance with the number of pulses of at least any one of the pulse trains, based on the phase-lead-lag between the pulse trains, when the operation member is operated during an operation of the timer means such that the first and second pulse trains are generated by the pulse signal generating means, thereby changing a set period, said adding or subtracting means being incorporated in the microcomputer.

When the operation member is turned during execution of the cooking operation, the control device determines in which direction the operation member has been turned, based on the phase-lead-lag relation between the first and second pulse trains generated by the pulse signal generating means. The control device operates to change the cooking period information in accordance with the direction in which the operation member has been turned, by adding or subtracting, to or from the cooking period information, the time length based on the number of pulses in the pulse train. Consequently, the cooking period may be changed during the execution of the cooking operation by one operation of a single operation member.

Preferably, the pulse generating means may comprise a moving member moved by the operation member in the direction in which the operation member is operated and a large number of scan points disposed at predetermined intervals in two rows in the direction in which the moving member is moved, one of the rows of scan points being shifted relative to the other row in the direction in which the moving member is displaced, each scan point generating a pulse every time the moving member passes each scan point.

It is preferable that the start means may comprise a first semiconductor switch operated in response to the pulse train generated by the pulse signal generating means to thereby generate a status signal and a second semiconductor switch responsive to an output as the result of logical multiplication of a start instruction signal generated by the microcomputer in response to the pulse trains and the status signal, thereby starting the operation of the cooking means.

Other objects of the present invention will become obvious upon an understanding of the illustrative embodiments about to be described in the appended claims, and various advantages not referred to herein will occur to one skilled in the art upon employment of the invention in practice.

BRIEF DESCRIPTION OF THE DRAWINGS

In the accompanying drawings:

FIG. 8 shows relationships between operation of an operation knob and a display and a normally-open contact of a main relay.

DESCRIPTION OF THE PREFERRED EMBODIMENT

An embodiment in which the invention is applied to a microwave oven will now be described with reference to the drawings.

Figure 1:
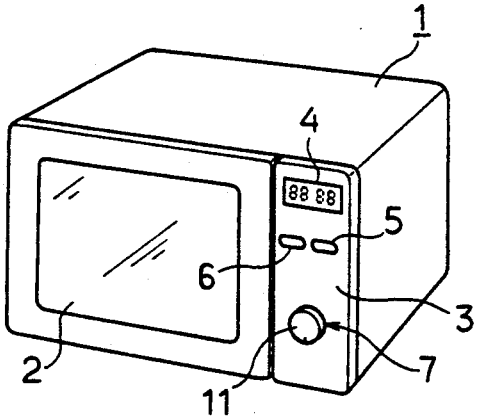
FIG. 1 is a perspective view of a microwave oven of an embodiment of the invention.

Referring first to FIG. 1, a microwave oven embodying the invention includes a housing 1 having a front opening. A door 2 is pivotally mounted so as to close the front opening of housing 1. An operation panel 3 is mounted on the right-hand front side of housing 1 so as to be adjacent to door 2, as viewed in FIG. 1. Operation panel 3 includes a seven-segment type display 4 disposed on the upper side thereof, a high output selection switch 5 and a low output selection switch 6 disposed below display 4, and an encoder 7 disposed below selection switches 5 and 6 and serving as pulse signal generating means.

Figure 2:
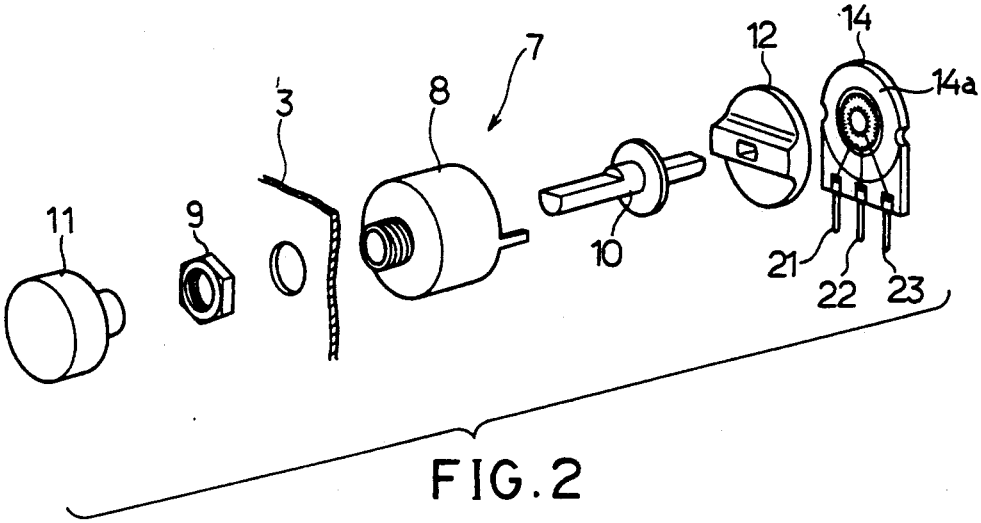
FIG. 2 is an exploded view of a rotary encoder provided in the microwave oven.
Figure 3:
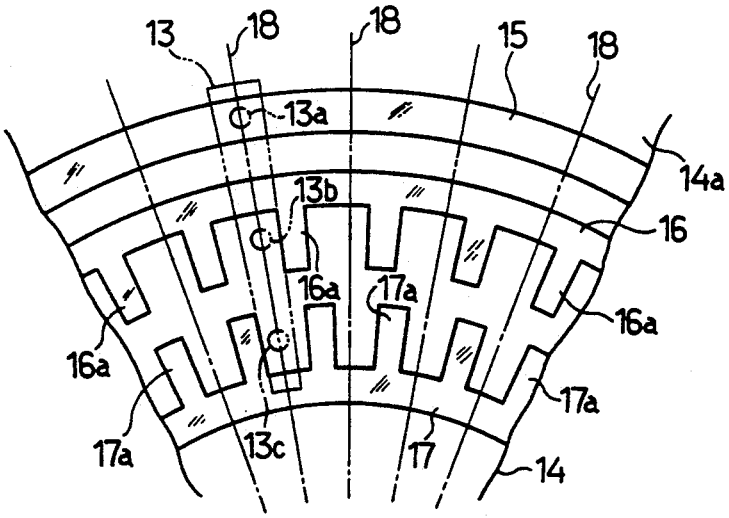
FIG. 3 is a segmentary view of a switch substrate of the rotary encoder.

Encoder 7 will be described in detail with reference to FIGS. 2 and 3. A switch case 8 is mounted on operation panel 3 by a nut 9. A switch shaft 10 is rotatably mounted on switch case 8. One end of switch shaft 10 is outwardly projected through operation panel 3 and an operation knob 11 is coupled with the projected end of switch shaft 10 so as to be rotated therewith. A moving member or contact disc 12 is coupled with the other end of switch shaft 10 so as to be rotated therewith. A contact arm 13 carrying contacts 13*a*, substrate 14 comprising a printed wiring board is attached to switch case 8. Switch substrate 14 has, at one side, concentrically printed common conductive pattern 15, first conductive pattern 16 and second conductive pattern 17. A large number of scan points or pulse generating conductors 16*a* are printed on the inner periphery of first conductive pattern 16 at equal pitches. A large number of scan points or pulse generating conductors 17*a* are also printed on the outer periphery of second conductive pattern 17 at pitches same as in pulse generating conductors 16*a*. Pulse generating points 17*a* are slightly shifted relative to pulse generating points 16*a* in the clockwise direction. A large number of groove-like contact stops 18 are radially formed so as to be positioned between each pulse generating point 16*a* and its adjacent ones and between each pulse generating point 17*a* and its adjacent ones. Contacts 13*a*–13*c* of contact arm 13 are positioned on one of contact stops 18. Contact 13*a* is brought into contact with common conductive pattern 15. Contact 13*b* is brought into contact with a portion of surface 14*a* between pulse generating conductors 16*a*. Contact 13*c* is brought into contact with a portion of surface 14*a* between pulse generating conductors 17*a*. A first switch 19 (see FIG. 4) comprises common conductive pattern 15, contact arm 13, contacts 13*a*, 13*b* and first conductive pattern 16. A second switch 20 (see FIG. 4) comprises common conductive pattern 15, contact arm 13, contacts 13*a*, 13*c* and second conductive pattern 17. Switches 19 and 20 are of the normally open type. When operation knob 11 is turned, contact disc 12 is turned via switch shaft 10 and consequently, contact 13*b* is brought into contact with pulse generating conductor 16*a*. First switch 19 is closed when contact arm 13 causes a short between first conductive pattern 16 and common conductive pattern 15. Second switch 20 is closed when contact 13*c* is brought into contact with pulse generating conductor 17*a* such that contact arm 13 causes a short between second conductive pattern 17 and common conductive pattern 15. Lead terminals 21, 22 and 23 on switch substrate 14 are electrically connected to conductive patterns 15, 16 and 17, respectively.

Figure 4:
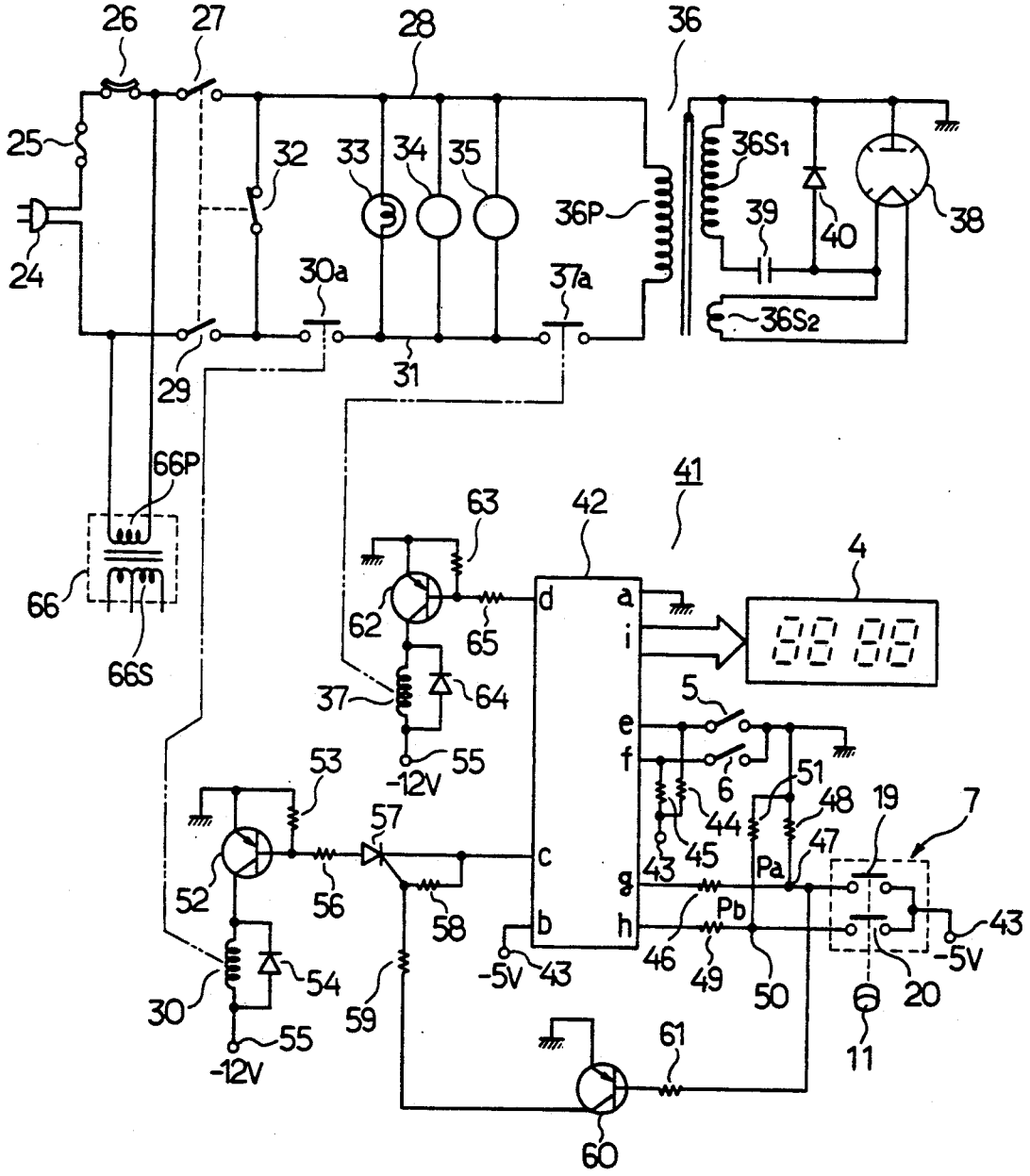
FIG. 4 is an electrical circuit diagram of the microwave oven.
Figure 5:
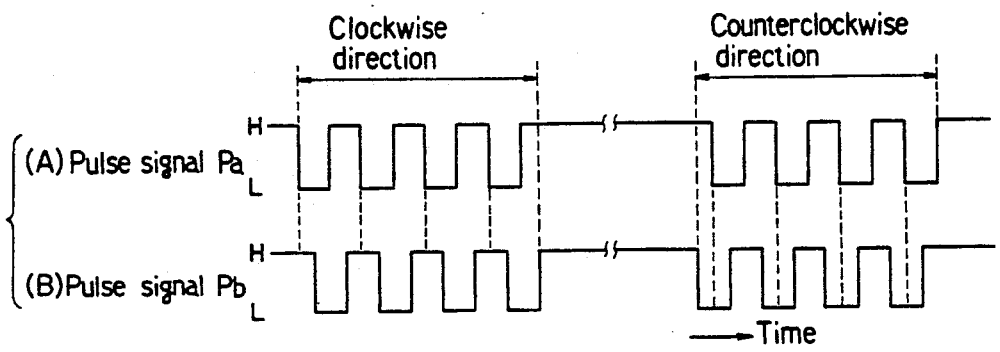
FIGS. 5(A) and 5(B) illustrate a waveform chart of pulse signals generated by the rotary encoder.

An electrical arrangement of the microwave oven will be described with reference to FIG. 4. One of terminals of a power supply plug 24 is connected to a power supply line 28 through a fuse 25, thermal switch 26 and first door switch 27. The other terminal of plug 24 is connected to a power supply line 30 through a second door switch 29 and a normally open contact 30*a* of a main relay 30. A short switch 32 operated in response to closure and opening of door 2 is connected between power supply line 28 and a common contact of door switch 29 and normally open contact 30*a*. Door switches 27 and 29 are opened and closed in response to opening and closure of door 2 while short switch 32 is opened and closed in response to opening and closure of door switches 27 and 29. A pilot lamp 33 provided in housing 1 is connected between power supply lines 28 and 31. A turntable motor 34 is provided for driving a turntable (not shown) mounted in housing 1. Turntable motor 34 is also connected between power supply lines 28 and 31. A fan motor 35 is provided for driving a fan for the purpose of cooling a magnetron 38 which will be described later. Fan motor 35 is also connected between power supply lines 28 and 31. Reference numeral 36 designates a high-voltage transformer having a primary coil 36P connected in series to a normally open contact 37*a* of a power control relay 37 and further connected between power supply lines 28 and 31. One of terminals of one secondary coil $36S_1$ of transformer 36 is connected to the iron core and the anode of magnetron 38 and further grounded. The other terminal of secondary coil $36S_1$ is connected to one of terminals of a heater of magnetron 38 through a high-voltage capacitor 39. Both terminals of the other secondary coil $36S_2$ of transformer 36 are connected to both terminals of a magnetron heater(not shown), respectively. A high-voltage diode 40 is connected in parallel with a series circuit of secondary coil $36S_1$ and capacitor 39.

Reference numeral 41 designates a microcomputer-based control device. A power supply port a of a microcomputer 42 is grounded and a power supply port b thereof is connected to a DC power supply terminal 43 to which a DC voltage of minus 5 volts is supplied. An input port e of microcomputer 42 is grounded through high output selection switch 5 and connected to DC power supply terminal 43 through a resistance 44. An input port f of microcomputer 42 is grounded through low output selection switch 6 and connected to DC power supply terminal 43 through a resistance 45. An input port g of microcomputer 42 is connected in series to a resistance 46 and first switch 19 and grounded. An output terminal 47 as common connection of resistance 46 and first switch 19 is grounded through a resistance 48. An input port h is connected in series to a resistance 49 and second switch 20 and grounded. An output terminal 50 as common connection of resistance 49 and second switch 20 is grounded through a resistance 51. An input port i of a plurality of bits is connected to display 4. The emitter of a PNP transistor 52 is grounded and further connected to the base through a resistance 53. The collector of transistor 52 is connected through a parallel circuit of main relay 30 and diode 54 to a DC power supply terminal 55 to which a DC voltage of minus 12 volts is supplied. The base of transistor 52 is connected in series to a resistance 56 and a thyrister 57 and further connected to output port c of microcomputer 42. The gate of thyrister 57 is connected to the cathode through a resistance 58 and further connected to the collector of a PNP transistor 60 through a resistance 59. The emitter of transistor 60 is grounded and the base thereof is output terminal 47 through a resistance 61. The emitter of a PNP transistor 62 is grounded and connected to the base thereof through a resistance 63. The collector of transistor 62 is connected to DC power supply terminal 55 through a series circuit of power control relay 37 and diode 64. The base of transistor 62 is connected to output port d of microcomputer 42 through a resistance 65. Terminals of a primary coil 66P of a control power supply transformer 66 are connected the common connection of thermal switch 26 and first door switch 27 and the other terminal of power supply plug 24, respectively An AC voltage excited at a secondary coil 66S is full-rectified and smoothed to be regulated, thereby obtaining various DC power supply voltages.

Figure 6:
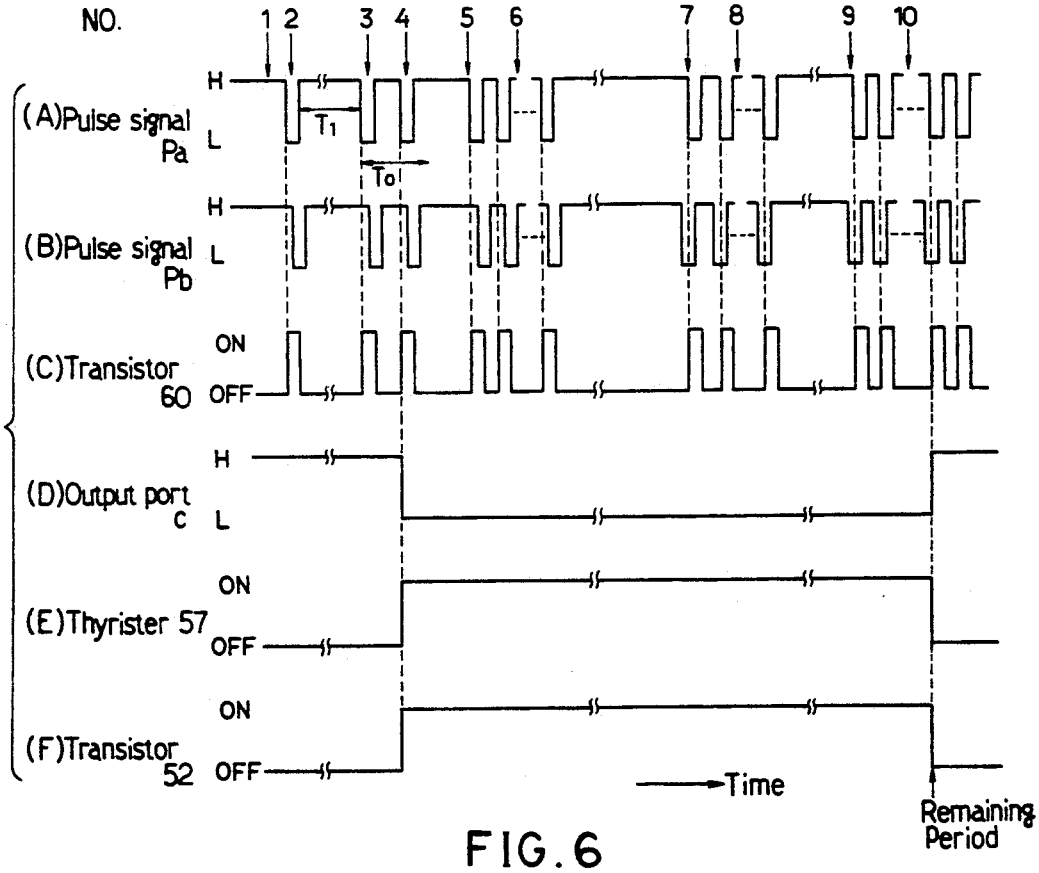
FIGS. 6(A) to 6(F) illustrate a time chart of the operation of the microwave oven.
Figure 7:
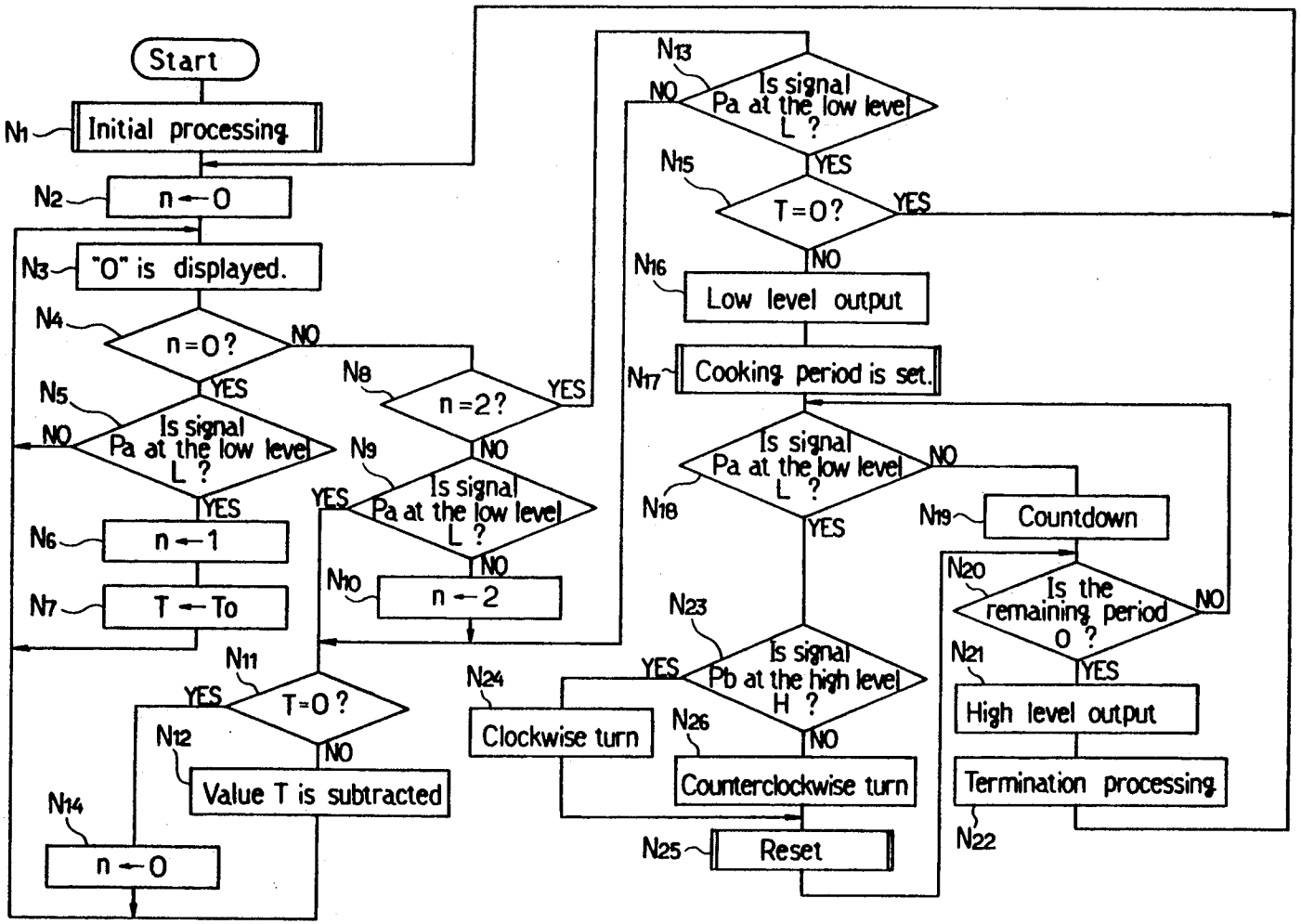
FIG. 7 is a flowchart of the operation of the microwave oven.

Operation of the above-described arrangement will now be described with reference to FIGS. 5 to 8. Description will first be given to the encoder. When operation knob 11 is turned such that contact disc 12 is turned via shaft 10, contacts **13*a*–13*c* of contact arm 13 are moved in the clockwise direction from contact stop 18 of the original position to the following contact stop 18. Contacts 13*b* and 13*c* are brought into contact with pulse generating conductors 16*a* and 17*a* during the movement of contact arm 13 and pass them, respectively. Such contact operations of contacts 13*b* and 13*c* close respective switches 19 and 20 with the result that the level of each of pulse signals Pa and Pb is changed to a low level L (minus 5 volts). Accordingly, upon turn of operation knob 11, pulse signals Pa and Pb are generated as shown in FIGS. 6(A) and 6(B) and the number of pulses of each signal is in accordance with a turn angle of operation knob 11. When operation knob 11 is turned in the clockwise direction, the changes of pulse signal Pb between the high level H and the low level L slightly lag behind those of pulse signal Pa (phase lag). On the other hand, when the operation knob 11 is turned in the counterclockwise direction, the changes of pulse signal Pa between the high level H and the low level L slightly lag between those of pulse signal Pb. Accordingly, when pulse signal Pb is at the high level H at the time pulse signal Pa is changed from the high level H to the low level L, microcomputer 42 determines that operation knob 11 has been turned in the clockwise direction. When pulse signal Pb is at the low level L at that time, microcomputer 42 determines that operation knob 11 has been turned in the counterclockwise direction. The turning of operation knob 11 in the clockwise or counterclockwise direction accompanies a click every time contacts 13*a*–13*c* of contact arm 13 are positioned at contact stop 18. As a result, contacts 13*a*–13*c* may be moved by one pitch from one contact stop 18** to another with certainty.

When power supply plug 24 is connected to a power source plug socket (not shown), microcomputer 42 initiates its operation and executes a subroutine $N_1$ of an initial processing. Microcomputer 42 advances to a processing step $N_2$ after necessary initial processing operations. At step $N_2$, the content n of a pitch counter (not shown) for counting the pitches of operation knob 11 is reset to "0." At an output step $N_3$, microcomputer 42 operates to display "0" on display 4 by controlling output from output port i. Microcomputer 42 then advances to determining steps $N_4$ and $N_5$ in turn. Both of switches 19 and 20 are open when contacts **13*a*–13*c* of encoder 7 is positioned at any one contact stop 18. Accordingly, pulse signals Pa and Pb from respective output terminals 47 and 50 are at the high level (0 volts). Microcomputer 42 determines that pulse signal Pa is not at the low level L, at step $N_5$, returning to step $N_3$. Thereafter, microcomputer 42 reiterates steps $N_4$, $N_5$ and $N_3$ and is then on standby. See FIG. 7 and column No. 1 in FIG. 8**.

When operation knob 11 is turned by one pitch in the clockwise direction so that contacts **13*a*–13*c* are moved from the original contact stop 18 to the following first one, pulse signal Pa is decremented to the low level L in an instant during turn of operation knob 11. Microcomputer 42 determines at step $N_5$ that pulse signal Pa has been at the low level L. See FIG. 7 and column No. 2 in FIG. 8. Microcomputer 42 then advances to a processing step $N_6$, where microcomputer 42 operates to set the content n of pitch counter at "1." Subsequently, microcomputer 42 advances to a processing step $N_7$ to set the built-in timer. Time $P_0$ is set as timer time T at timer and microcomputer 42 then returns to step $N_3$ to display "0" on display 4. Microcomputer 42 advances to step $N_4$ from step $N_3$ and then to a determining step $N_8$. Microcomputer 42 determines at step $N_8$ that n is not 2 and advances to a determining step $N_9$. In the case that one pitch turn of operation knob 11 has been completed, microcomputer 42 determines at step $N_9$ that pulse signal Pa is not at the low level L, thereby advancing to a processing step $N_{10}$. The content n of the pitch number counter is set at 2. Then, microcomputer 42 advances to a determining step $N_{11}$ where it determines that timer time T is not 0. Then, at a processing step $N_{12}$, subtraction of timer time T is performed and microcomputer 42 returns to step $N_3$. Subsequently, when returning to step $N_8$ through step $N_4$, microcomputer 42 determines that the content n of the pitch counter is 2, then advancing to a determining step $N_{13}$. Microcomputer 42 determines at step $N_{13}$ that pulse signal Pa is not at the low level L and returns to step $N_{11}$. Thus, steps $N_{12}$, $N_3$, $N_4$, $N_8$, $N_{13}$ and $N_{11}$ are reiterated, thereby performing subtraction of the timer period T ($T_0$). While the subtracting operation is being performed or so long as operation knob 11 is not turned before timer period T, that is, $T_0$ reaches 0, so that contacts 13a–13c are moved by one pitch from the first contact stop 18 to the second contact stop 18, microcomputer 42 determines at step $N_{13}$ that pulse signal Pa is not at the low level L, returning to step $N_{11}$. When timer period T or $T_0$ reaches 0, microcomputer 42 determines at step $N_{11}$ that timer period T or $T_0$ has reached 0, then advancing to a processing step $N_{14}$. At step $N_{14}$, the content n of the pitch counter is reset to 0. Thereafter, microcomputer 42** returns to the standby mode, reiterating steps $N_3$, $N_4$ and $N_5$.

When operation knob 11 is turned in the clockwise direction so that contacts 13a–13c are moved by one pitch from first contact stop 18 to the second one, a predetermined period $T_1$ ($T_1 > P_0$) after operation knob 11 is turned so that contacts 13a–13c are moved from the original position to the first contact stop 18, microcomputer 42 again performs the subtraction of the timer set period T or $T_0$ through steps $N_5$ to $N_7$, $N_3$, $N_4$, $N_8$ to $N_{12}$, $N_3$, $N_4$, $N_8$, $N_{13}$ and $N_{11}$ in turn. When $T_0$ reaches 0, the content n of the pitch counter is reset to 0 at step $N_{14}$, in the same manner as described above. See FIG. 7 and column No. 3 in FIG. 8. On the other hand, when operation knob 11 is turned in the clockwise direction during the subtraction of the timer set period T so that contacts 13a–13c are moved by one pitch from the first contact stop 18 to the second one or while microcomputer 42 determines at step $N_8$ that the content n of the pitch counter is "2," before the timer set period $T_0$ reaches 0, microcomputer determines at step $N_{13}$ that pulse signal Pa is at the low level L, advancing to a determining step $N_{15}$. Microcomputer 42 determines at step $N_{15}$ that the timer set period T has not reached 0, thereby advancing to an output step $N_{16}$. See FIG. 7 and column No. in FIG. 8. At step $N_{16}$, a low level start signal is produced from output port c as shown in FIG. 6(D). Accordingly, since the pulse signal Pa is at the low level L as shown in FIG. 6(A), transistor 60 is turned on as shown in FIG. 6(C), thereby turning on thyrister 57 as shown in FIG. 6(E). With turn-on of thyrister 57, transistor 52 is turned on as shown in FIG. 6(F). Consequently, main relay 30 is energized, thereby closing normally open contact 30a. Since door switches 27 and 29 have already been closed with closure of door 2, pilot lamp 33 and motors 34 and 35 are energized and the electrical power is supplied to magnetron 38 through normally open contact 37a which is closed continuously or intermittently, thereby starting the cooking operation. Second semiconductor switch or thyrister 57 is adapted to be responsive to the result of logical multiplication of the status signal generated by first semiconductor switch or transistor 60 in response to the operation of knob 11 of encoder 7 and the cooking start signal (low level signal) generated from output port c of microcomputer 42. Consequently, a false start of the cooking operation due to malfunction of microcomputer may be prevented. When high output switch 5 is closed, microcomputer 42 operates so that the signal produced from output port d is continuously maintained at the low level L. When low output switch 6 is closed, microcomputer 42 operates so that the signal produced from output port d is intermittently maintained at the low level. Accordingly, normally open contact 37a of power control relay 37 is closed continuously or intermittently, thereby controlling the output of magnetron 38.

As obvious from the foregoing, when operation knob 11 is turned so that contact arm 13 is moved one pitch within the predetermined period $T_0$, main relay 30 is not operated and magnetron 38 is not energized. On the other hand, when operation knob 11 is turned so that contact arm 13 is moved two pitches within the period $T_0$, microcomputer 42 supplies an operation signal with main relay 30, which is activated. Such an operation of microcomputer 42 effectuates the signal generated at the time operation knob 11 is turned so that contact arm 13 is moved two pitches within period $T_0$, thereby preventing a malfunction due to an electrical noise. When advancing to step $N_9$ while operation knob 11 is being turned so that contact arm 13 is moved one pitch, microcomputer 42 determines at step $N_9$ that signal Pa is at the low level L and directly returns to step $N_{11}$. As a result, the operation of knob 11 for the first one pitch movement of contact arm 31 may be prevented from being falsely counted as that of the second one pitch movement of contact arm 13. Furthermore, when the timer period is 0 at the time microcomputer 42 determines at step $N_{13}$ that signal Pa is at the low level L, microcomputer 42 determines at step $N_{15}$ that timer period T is 0, thereby returning to step $N_2$. Consequently, operation of knob 11 is automatically disabled when operation knob 11 is turned too slowly.

Microcomputer 42 then advances from step $N_{16}$ to a subroutine $N_{17}$ for the cooking period setting. Since operation knob 11 has been turned so that contact arm 13 is moved from the first contact stop 18 to the second one, the minimum period corresponding to one pitch movement of the contact arm, for example 10 seconds, is set in the cooking period counter and microcomputer 42 operates to display the content of cooking period counter on display 4. Similarly, when operation knob 11 is turned by n pitches so that contact arm 13 is moved from the first stop by n pitches, the period of ($10 \times n$) seconds is set in the cooking period counter. Microcomputer 42 then advances to a determining step $N_{18}$. Since pulse signal Pa is at the high level H in the case where operation knob 11 has not been turned, microcomputer 42 determines at step $N_{18}$ that pulse signal Pa is not at the low level L, thereby advancing to a processing step $N_{19}$. At step $N_{19}$, the content of the cooking period counter is counted down one step corresponding to "one second" from "10" to "9." Simultaneously, the content on display is changed from "10" to "9." Advancing to a determining step $N_{20}$, microcomputer 42 determines whether or not the remaining period is 0. Microcomputer 42 determines that the remaining period is not 0 and reiterates steps $N_{18}$–$N_{20}$, counting down the cooking period set at the counter. Thereafter, when the content of the cooking period counter reaches 0, microcomputer 42 determines at step $N_{20}$ that the remaining period is 0, advancing to an output step $N_{21}$. Microcomputer 42 changes output at output port c to the high level H at step $N_{21}$. Consequently, thyrister 57 and transistor 52 are turned off in turn. Main relay 30 is deenergized with the result that normally open contact 30a thereof is opened, thereby terminating the cooking operation. After a predetermined processing at a subroutine $N_{22}$, microcomputer 42 returns to step $N_2$.

On the other hand, consider now that the content of the cooking period counter is "7" corresponding to seven seconds in the cooking operation wherein steps $N_{18}$–$N_{20}$ are reiterated or in the condition that contact arm 13 is positioned at the n-th contact stop as the result that operation knob 11 has been turned so that contact arm 13 is moved by two pitches or more within period $T_0$. When operation knob 11 is turned in the clockwise direction so that contact arm 13 is moved by a desirable number of pitches under the above-described condition, microcomputer 42 determines at step $N_{18}$ that signal Pa is at the low level L, in response to the initial one pitch movement of contact arm 13, thereby advancing to a determining step $N_{23}$. When pulse signal Pb is changed to the high level H, microcomputer 42 determines at step $N_{23}$ that signal Pb is at the high level H, and advances to a subroutine $N_{25}$ for reset through a processing step $N_{24}$ for the clockwise turn of knob 11. See FIG. 7 and column No. 5 in FIG. 8. Based on the processing at step $N_{24}$, microcomputer 42 determines at subroutine $N_{25}$ that the operation to be performed is an adding operation. Microcomputer 42 counts the number of pulse signals Pa generated with subsequent turn of operation knob 11 and operates to add, to the content of the cooking period counter, the cooking period in accordance with the number of counted pulses. See FIG. 7 and column No. 6 in FIG. 8. The changing content of cooking period counter is sequentially displayed on display 4. When turn of operation knob 11 is stopped at the time the content of the counter represents "five minutes and thirty-four seconds," microcomputer 42 returns to step $N_{20}$. Thereafter, when operation knob 11 is turned in the counter-clockwise direction so that contact arm 13 is moved by a desirable number of pitches at the time the content of the counter represents "four minutes," for example, microcomputer 42 determines at step $N_{18}$ that signal Pa is at the low level L, advancing to step $N_{23}$. Microcomputer 42 determines at step $N_{23}$ that signal Pb is not at the high level H and advances to the subroutine $N_{25}$ through a processing step $N_{26}$ for the counterclockwise turn of operation knob 11. See FIG. 7 and column No. 7 in FIG. 8. Microcomputer 42 determines at step $N_{25}$ that the operation to be performed is a subtracting operation, based on the processing at step $N_{26}$. Microcomputer 42 counts the pulse signals Pa and subtracts, from the remaining cooking period at the counter, the period in accordance with the number of counted pulses. See FIG. 7 and column No. 8 in FIG. 8. When the subtraction is completed at the time the content of the cooking period counter represents, for example, "two minutes and twenty-eight seconds," microcomputer 42 returns to step $N_{20}$. The cooking operation may be canceled during continuation of step $N_{20}$ in the following manner. For example, when operation knob 11 is again turned in the counterclockwise direction at the time the counter content represents "one minute and thirty seconds," microcomputer 42 determines at step $N_{18}$ that signal Pa is at the low level L, advancing to step $N_{23}$. Since pulse signal Pa is at the low level L, microcomputer determines at step $N_{23}$ that signal Pb is not at the high level H, advancing to subroutine $N_{25}$ through step $N_{26}$. At subroutine $N_{25}$, microcomputer determines that the operation to be performed is a subtracting operation, based on the processing at the previous step. Microcomputer 42 operates to count the number of pulse signals Pa and counter, the period in accordance with the number of counted pulses. See FIG. 7 and column No. 10 in FIG. 8. When the content of the cooking period counter represents "0 seconds," microcomputer 42 returns to step $N_{20}$. Since it is determined at step $N_{20}$ that the remaining period is 0, microcomputer 42 returns to step $N_2$ through step $N_{21}$ and subroutine $N_{22}$, thereby canceling the cooking operation.

As described above, when operation knob 11 is initially turned so that contact arm 13 is moved by a plurality of pitches within period $T_0$, the cooking period is set in accordance with the number of pitches at microcomputer 42 at step $N_{17}$ and main relay 30 is operated so that the cooking operation is initiated. When operation knob 11 is turned during the cooking operation, the cooking period is incremented, decremented or canceled in accordance with an amount and direction of turn of operation knob 11. Consequently, start of the cooking operation needs one time of operation of a single operation knob, not necessitating a cooking start key as in the conventional microwave ovens, thereby simplifying the cooking start operation. In the case of changing the cooking period, only turn of the operation knob is needed, which simplifies the cooking period changing and does not need a cancel key, thereby reducing the production cost of the microwave oven.

Although the contact type encoder is employed in the foregoing embodiment, a photoelectric or electromagnetic encoder may be employed instead.

Although the invention is applied to a microwave oven in the foregoing embodiment, it may be applied to a heating cooking appliance and other cooking appliances having a heating source.

The foregoing disclosure and drawings are merely illustrative of the principles of the present invention and are not to be interpreted in a limiting sense. The only limitation is to be determined from the scope of the appended claims.

What I claim is:

1. A cooking appliance including cooking means for cooking food, a control device for controlling the cooking means, the control device including a microcomputer, and a manual operation member provided so as to be displaced when manually operated, said control device comprising:

a) timer means for defining an operation period of the cooking means, said timer means being incorporated in the microcomputer;

b) pulse signal generating means for generating a pulse train having pulses the number of which is in accordance with an amount of displacement of the operation member, said pulse generating means being provided independent of the microcomputer;

c) start means for starting an operation of the cooking means in response to one or more pulses of the pulse train generated by the pulse signal generating means, said start means being incorporated in the microcomputer; and d) period setting means for setting, at the timer means, a period in accordance with the number of pulses of the pulse train generated by the pulse signal generating means.

2. A cooking appliance according to claim 1, wherein the start means is responsive, at least, to the first two pulses of the pulse train generated by the pulse signal generating means, said first two pulses being generated within a predetermined period.

3. A cooking appliance according to claim 1, wherein the start means comprises a first semiconductor switch operated in response to the pulse train generated by the pulse signal generating means to thereby generate a status signal and a second semiconductor switch responsive to an output as the result of logical multiplication of a start instruction signal generated by the microcomputer in response to the pulse train and the status signal, thereby starting the operation of the cooking means.

4. A cooking appliance including cooking means for cooking food, a control device for controlling the cooking means, the control device including a microcomputer, and a manual operation member provided so as to be displaced when manually operated, said control device comprising:

a) timer means for defining an operation period of the cooking means, said timer means being incorporated in the microcomputer;

b) pulse signal generating means for generating first and second electrical pulse trains in response to a displacement of the operation member, the number of pulses of each pulse train being in accordance with an amount of displacement of the operation member, said first and second pulse trains having a phase difference therebetween, the phase-lead-lag of said pulse trains being determined by the directions of displacement of the operation member, said pulse signal generating means being provided independent of the microcomputer;

c) start means for starting an operation of the cooking means in response to one or more pulses of at least any one of the first and second pulse trains generated by the pulse signal generating means, said start means being incorporated in the microcomputer; and d) period setting means for setting, at the timer means, a period in accordance with the number of pulses of any one of the pulse trains generated by the pulse signal generating means; and e) means for adding or subtracting, to or from the time length value currently set in the timer means, a period in accordance with the number of pulses of at least any one of the pulse trains, based on the phase-lead-lag between the pulse trains, when the operation member is operated during an operation of the timer means such that the first and second pulse trains are generated by the pulse signal generating means, thereby changing a set period, said adding or subtracting means being incorporated in the microcomputer.

5. A cooking apparatus according to claim 4, wherein the pulse signal generating means comprises a moving member moved by the operation member in the direction in which the operation member is operated and a large number of scan points disposed at predetermined intervals in two rows in the direction in which the moving member is moved, one of the rows of scan points being shifted relative to the other row in the direction in which the moving member is displaced, each scan point generating a pulse every time the moving member passes each scan point.

6. A cooking apparatus according to claim 4, wherein the start means is responsive, at least, to the first two pulses of the pulse train generated by the pulse signal generating means, said first two pulses being generated within a predetermined period.

* * * * *